US007459870B2

(12) United States Patent
Beck et al.

(10) Patent No.: US 7,459,870 B2
(45) Date of Patent: Dec. 2, 2008

(54) MACHINE STATUS INTERLOCK FOR REVERSING FAN CONTROL

(75) Inventors: Brad Beck, Peru, IL (US); Hong-Chin Lin, Glenview, IL (US); Joel Christian, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 180 days.

(21) Appl. No.: 11/634,770

(22) Filed: Dec. 6, 2006

(65) Prior Publication Data

US 2008/0136357 A1 Jun. 12, 2008

(51) Int. Cl.
*H02P 1/22* (2006.01)
*F24F 7/00* (2006.01)

(52) U.S. Cl. ..... 318/280; 318/268; 318/260

(58) Field of Classification Search ..... 318/260, 318/280, 268, 283, 471
See application file for complete search history.

(56) References Cited

U.S. PATENT DOCUMENTS 5,879,466 A 3/1999 Creger et al.
6,188,189 B1 * 2/2001 Blake ..... 318/471
6,427,461 B1 * 8/2002 Whinery et al. ..... 62/176.6
6,719,207 B2 * 4/2004 Kloster ..... 236/11
6,750,623 B1 6/2004 McCauley et al.
7,142,967 B2 * 11/2006 Brandt et al. ..... 701/50

OTHER PUBLICATIONS

Cat Service Information System; Operation and Maintenance Manual; Jan. 12, 2004; pp. 1-37; https://sis.cat.com/sisweb/sisweb/techdoc/techdoc.

* cited by examiner

*Primary Examiner*—Paul Ip
(74) *Attorney, Agent, or Firm*—Liell & McNeil

(57) ABSTRACT

The air circulation fan associated with a radiator of some machines may include an automatic reversing purge cycle that is utilized to dislodge material from the radiator and/or intake screen of the cooling system housing. The purge cycle is locked out when a person may be in the vicinity of the air intake screen of the machine. A controller determines that a person may be in the vicinity of the air intake screen when the machine is idle stationary, such as by determining that a parking brake is engaged. By locking out the purge cycle during machine idle stationary conditions, the risk of blowing dislodged dirt and/or debris onto a person, who may be servicing the machine or accessing an operator station, can be avoided.

20 Claims, 4 Drawing Sheets

MACHINE STATUS INTERLOCK FOR REVERSING FAN CONTROL

TECHNICAL FIELD

The present disclosure relates generally to reversing an air flow direction of a cooling fan to clear debris caught on an intake screen of a machine, and more particularly to locking out the air intake screen purge cycle when a person may be near the intake screen.

BACKGROUND

Many types of machines use an engine for motive power, and rely upon a radiator and an air circulation fan to assist in cooling the engine. The engine, radiator and fan are typically positioned within a housing that includes an air intake screen and an outlet opening. During normal operations, the fan draws air into the housing through the air intake screen, directs the air through the radiator and out of the housing through the outlet opening. In many types of applications, the machine may be working or traveling in a dirt and/or debris filled environment. As a result, materials such as dirt, insects, trash, leaves and the like can become lodged on the air intake screen. As material accumulates on the air intake screen, the effectiveness of the air circulation system, and hence the cooling capability of the associated radiator can be undermined.

One strategy for dealing with the accumulation of material on the radiator and air intake screen is taught in co-owned U.S. Pat. No. 6,750,623, which is entitled Reversible Automatic Fan Control System. In that reference, a fan control system periodically and automatically reverses the direction of the air flow system to dislodge accumulated materials from the radiator and air intake screen. After a brief purge cycle, the system automatically returns to its normal cooling operation and again reverses the air flow direction into its normal direction to circulate air from the air intake screen through the radiator and out of the outlet opening. While such an automated air circulation/purge cycle system can normally operate very effectively, and relieve an operator of manually monitoring and operating the fan in a purge cycle, the automated fan reversal system purging cycle can sometimes occur at an inopportune time.

Typically, the air circulation system will continue in its normal mode for some fixed duration, such as thirty (30) minutes, and then be followed by a brief purge cycle on the order of maybe thirty (30) seconds or less. This air circulation/purge cycling continues while the engine of the machine is running. In some instances, it may not be desirable for the purge cycle to occur, such as when a person may be in the vicinity of the air intake screen. In some machines, such as large landfill compactors and wheel loaders, the access path to the operator station actually crosses in front of the air intake screen. In other instances, a service point associated with the machine may be located in the vicinity of the air intake screen. Therefore, persons on an access path or at the service point could have debris blown onto them if the fan reverses direction to initiate a purge cycle.

The present disclosure is directed to one or more of the problems set forth above.

SUMMARY OF THE DISCLOSURE

In one aspect, a machine includes an air circulation system supported on a chassis, and includes a fan operably positioned between an air intake screen and an outlet opening of a housing. The fan has a first operation configuration operable to move air from the air intake screen and then out of the housing through the outlet opening, and a second operation configuration operable to move air through the air intake screen in a direction opposite to the first operation configuration. A controller is in control communication with the fan and configured to operate the fan in one of the first operation configuration and second operation configuration. The controller is also configured to lock out the second operation configuration when the machine is idle stationary.

In another aspect, an air circulation system fan is operated in a first operation configuration to move air from an air intake screen then out of the housing through an outlet opening. Debris is removed from the air intake screen by operating the fan in a second operation configuration that moves air through the air intake screen in a direction opposite to the first operation configuration. The second operation configuration is locked out when the machine is idle stationary.

DETAILED DESCRIPTION

Figure 1:
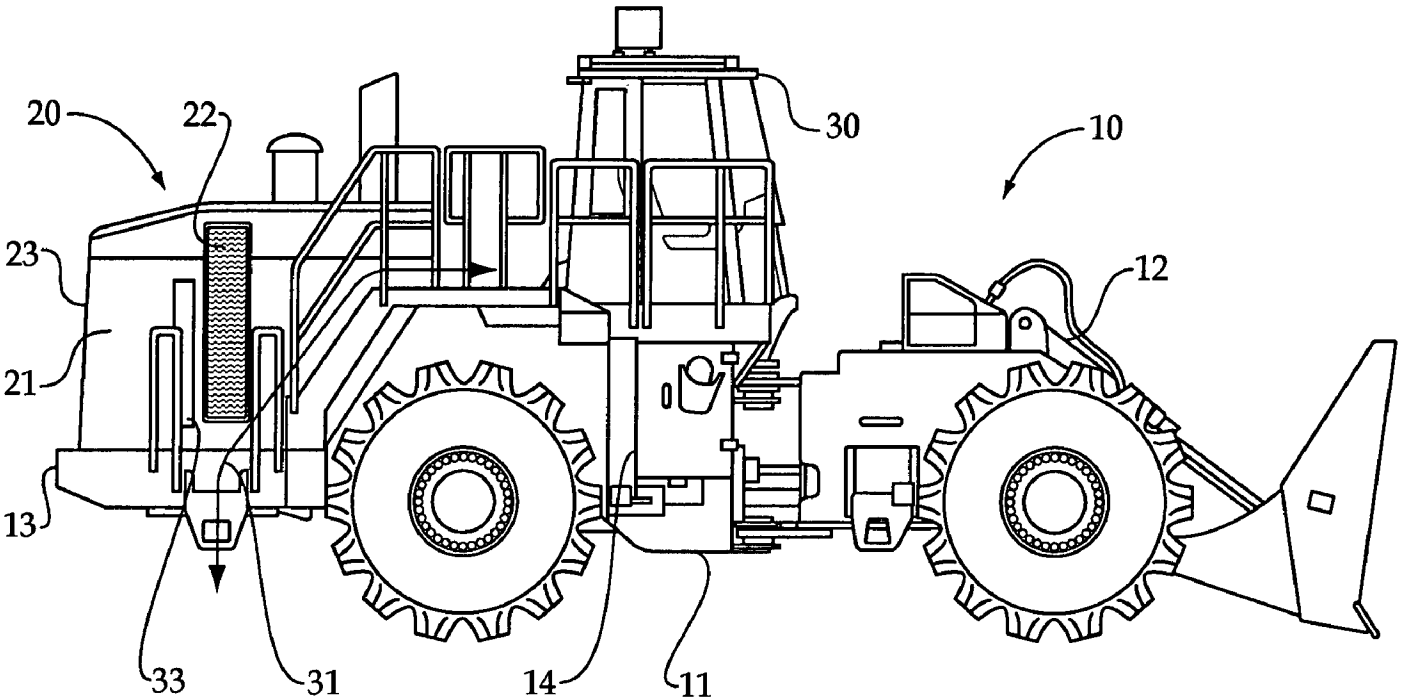
FIG. 1 is a side schematic elevational view of a landfill compactor machine according to the present disclosure.
Figure 3:
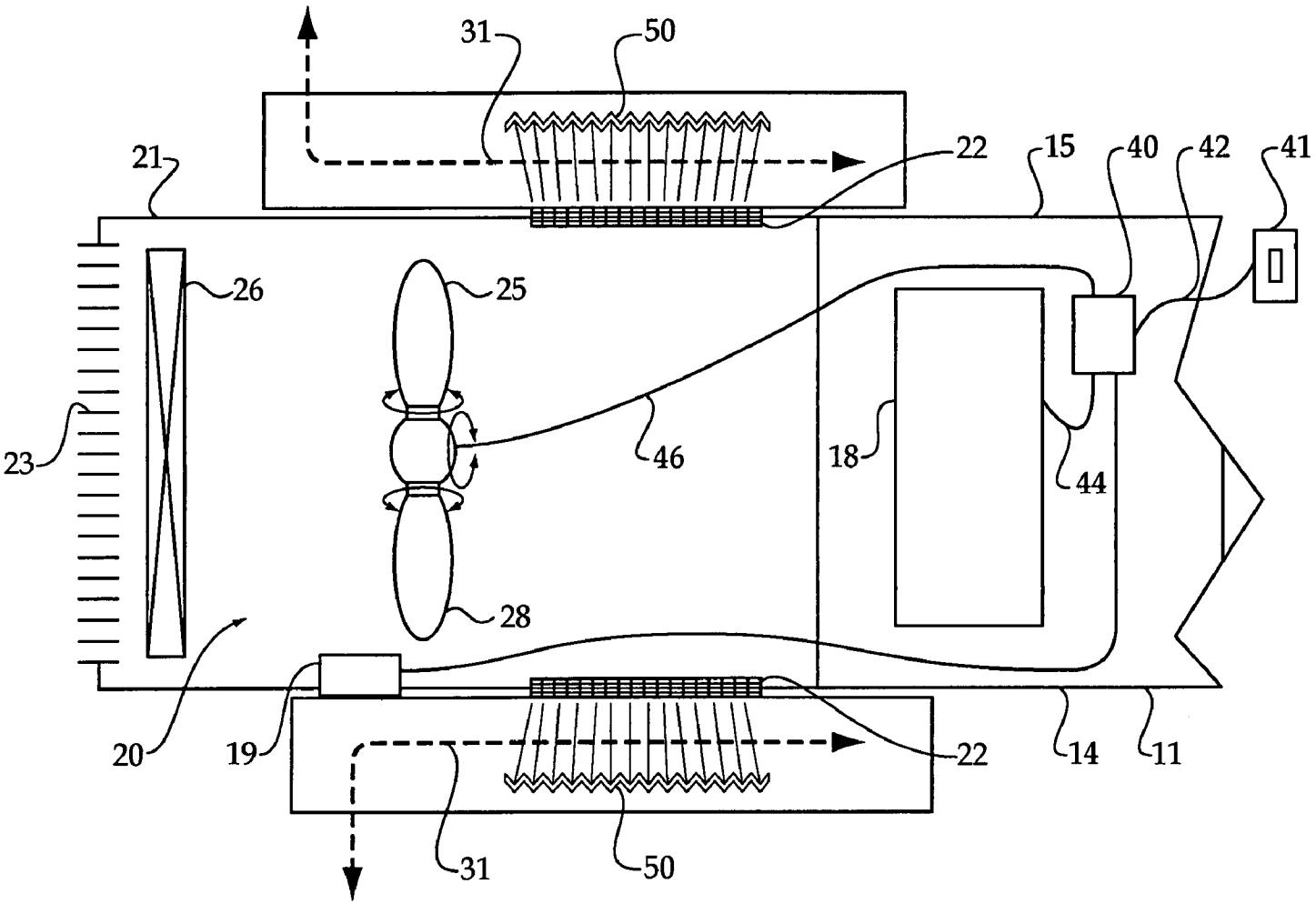
FIG. 3 is a top schematic view of the air circulation system portion of the machine of FIG. 1.

Referring to FIGS. 1 and 3, a landfill compactor machine 10 includes a chassis 11 with a front 12 separated from a back 13 by a first side 14 and a second side 15. Among other things, machine 10 may include a transmission 18, a parking brake 19, an air circulation system 20 and an operator station 30. The air circulation system 20 may include a fan and radiator positioned within a housing 21 between an air intake screen 22 and an outlet opening 23. Although the description refers to air intake screen 22 and outlet opening 23 in the singular, those skilled in the art will appreciate that there can be more than one of each without departing from the scope of the present disclosure. During normal operation, which may be referred to as a first operation configuration, a controller 40 controls fan 25 to pull air into housing 21 through air intake screen 22 and push the air through radiator 26 and out of housing 21 through outlet opening 23. Controller 40 may be configured in a manner taught in previously mentioned co-owned U.S. Pat. No. 6,750,623 to periodically reverse the fan to move air through the housing in an opposite direction. In other words, the fan may reverse a rotation direction or fan blade pitch orientation to pull air into the housing 21 via outlet opening 23 and push the air out of the housing through air intake screen 22. Although the illustrated embodiment shows an arrangement of the radiator being between the circulating fan and the outlet opening, those skilled in the art will appreciate that the air circulating fan could be on the other side of the radiator without departing from the scope of the present disclosure. Although the illustrated embodiments show the air intake screen 22 on the side of the machine 10, those skilled in the art will appreciate that other machines may have the air intake screen located on the front or back of the machine. For instance, some track type tractors include an air intake screen located on the back side of the machine, and the present disclosure is intended to encompass machines having an air intake screen at any location, even if different from that shown in the drawings.

This air flow direction reversal or purging cycle can facilitate dislodging material from radiator 23, and accumulated debris on air intake screen 22. The present disclosure contemplates cooling systems having a fan that reverses its rotation direction to facilitate the purging cycle, and also fans that continue to rotate in a single direction but include blades 28 whose pitch orientation is changed in order to reverse the air flow direction through housing 21. Machine 10 may include an access path 31 that passes in front of air intake screen 22. Also, machine 10 may include a service point 33, of a type well known in the art that may also be positioned adjacent air intake screen 22. During a purge cycle, purge material 50 may be dislodged and ejected from air intake screen 22 across access path 31 and/or in the vicinity of a service point 33. If a person were servicing machine 10 or was boarding or unboarding machine 10 via access path 31, the purged material 50 could literally be blown into their face. This type of undesirable event is most likely to occur when machine 10 is idle stationary.

By idle stationary, the present disclosure means that the machine is not moving and any implement is idle. Controller 40 may be configured to determine an idle stationary condition in a number of different ways. For instance, an idle stationary condition may be determined by controller 40 determining that transmission 18 is in neutral gear via communication line 44 and that the machine is not moving. Alternatively or in addition, an idle stationary condition might also be determined by detecting that parking brake 19 is engaged via a communication line 45. If the machine includes an implement, such as a bucket or blade, determination of an idle stationary condition might also require a determination that the implement is idle or not in use. In still another alternative, some machines are equipped with operator presence sensors, such as a seat switch in operation station 30, that a controller may utilize to determine whether an operator is in operator station 30. If an engine of the machine is running, but no operator is detected in the operator station, controller 40 might also determine that the machine is in an idle stationary condition. Those skilled in the art will appreciate that any combination and other known strategies may also be utilized by a controller to ascertain whether the machine is in an idle stationary condition, and hence that a person may be in the vicinity of the air intake screen.

A controller is configured to lock out the fan reversing purge cycle when the machine is in idle stationary condition. However, if a purge cycle has already been initiated before the machine arrives at an idle stationary condition, the controller may opt to complete the purge cycle before initiating a lock out of the purge cycle. In addition, the controller may be configured to maintain the lock out for some duration of time after an idle stationary condition has ended.

The machine may also include a manual means for initiating the fan reversing purge cycle. For instance, machine 10 may include a manual fan configuration switch 41 in communication with controller 40 via a communication line 42. This capability may give an operator the ability to initiate a fan reversing purge cycle at any time as circumstances may demand and for a duration determined by the operator, or for an automatic duration once the switch 41 is activated. In any event, fan 25 is controlled in its operation, whether in its first configuration circulating air in a normal cooling fashion, or in its reversed second configuration to facilitate a purging cycle, via commands generated by controller 40 and communicated to fan 25 via communication line 46. Those skilled in the art will appreciate that controller 40 may actually be two or more controllers that may or may not communicate with one another, but perform the tasks described herein to operate the machine 10 in accord with the present disclosure.

Figure 2:
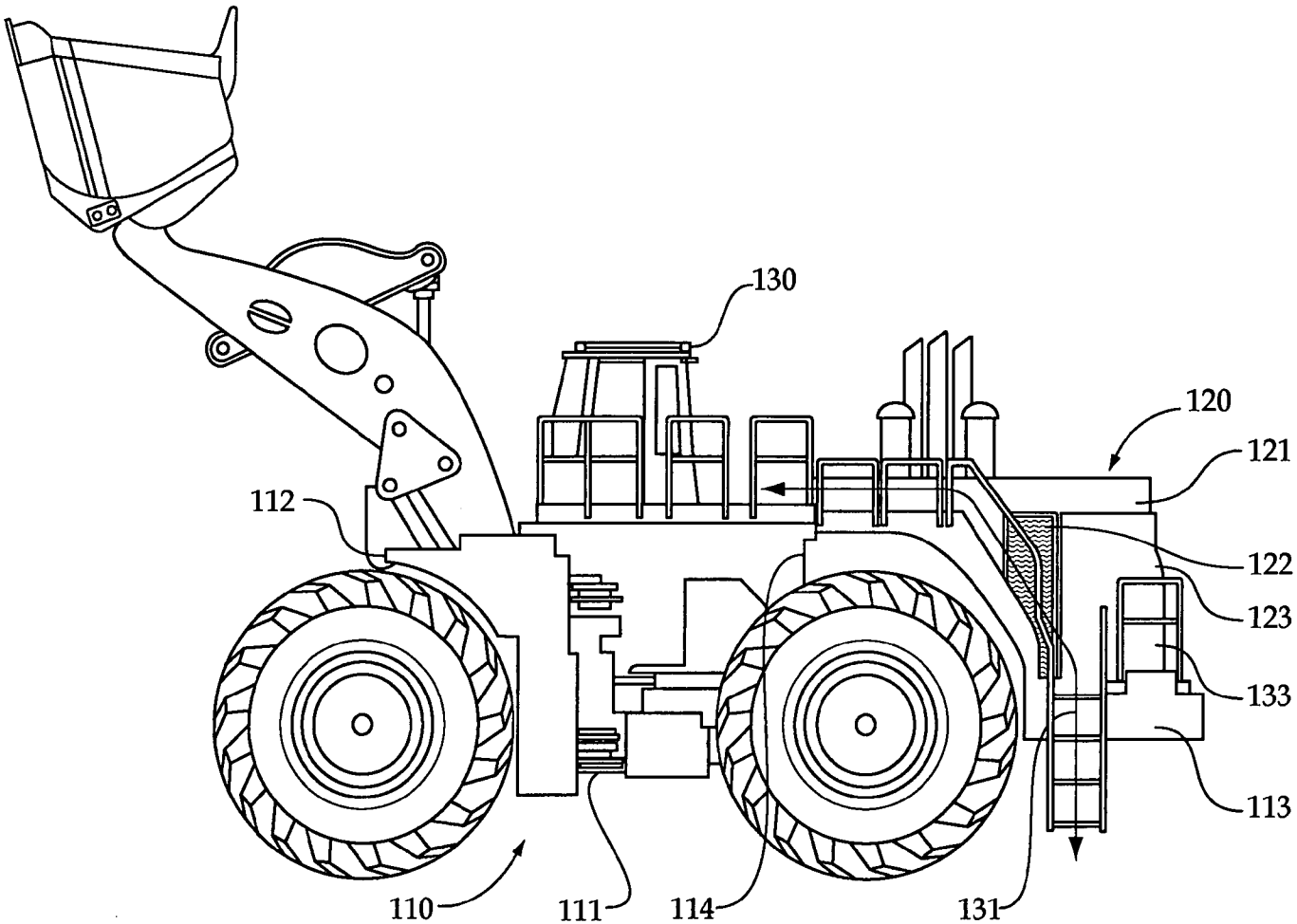
FIG. 2 is a side schematic elevational view of a wheel loader machine according to the present disclosure.

Referring now to FIG. 2, another machine 110, in this case a large wheel loader, also includes a configuration particularly suitable for the purge cycle interlock feature of the present disclosure. In particular, machine 110 include a chassis 111 with a front 112 separated by a back 113 by a first side 114 in a second side (not shown). An air circulation system 120 is supported on chassis 111 and includes a housing 121 within which a fan, and possibly a radiator (not shown) are located in a conventional manner. When operating in its normal first operation configuration to circulate air through the radiator, the fan will pull air into housing 121 through an air intake screen 122, pass the air through the radiator and out of housing 121 through outlet opening 123 at the back of the machine. As in machine 10, an access path 131 to the operator station 130 passes in front of the air intake screen 122. In addition, the machine 110 may include one or more service points 133 in the vicinity of air intake screen. Therefore, like the machine 10, the fan purging cycle would be inopportune if a person was in the vicinity of air intake screen 122.

INDUSTRIAL APPLICABILITY

Although this disclosure illustrates a landfill compactor and a large wheel loader, those skilled in the will appreciate that other machines may fall within the scope of the present disclosure. For instance, some large off road trucks include access paths to the operator station that pass directly in front of a radiator grill. In those instances, it would undesirable for any air circulation fan to reverse the air flow direction in a purge cycle when a person is traversing the access path to the operator station to avoid having dust and debris blown onto them. Those skilled in the art will appreciate that any machine that includes a fan reversal purge cycle capability could fall within the present disclosure, since many machines have service points in the vicinity of an air intake screen even though their access paths to operator stations do not pass in front of the air intake screen. Thus, when the machine's engine is running and the machine is stationary, and there is a possibility of a person being in the vicinity of an air intake screen, such as for servicing, the present disclosure would lock out the purging cycle while the machine is in an idle stationary condition.

The present disclosure finds potential application to any machine having an air circulation fan that includes a purge cycling capability that reverses air flow direction to remove accumulated debris from an air intake screen. This includes, but is not limited to, fans that actually reverse there rotational direction to accomplish the purge cycle, and also fans that continue to rotate in the same direction, but change blade pitch orientation to reverse air flow direction. Some examples of potential machines for which this invention could find potential application include machines such as landfill compactors, large wheel loaders, track type tractors, and possibly large off road trucks that include an access path to an operator station or a service point that passes in front of an air intake screen. In addition, the present disclosure finds potential application in any machine that may include a service point in the vicinity of an air intake screen, and such machines could include but are not limited to forestry machinery, track type tractors, excavators, motor graders, scrapers, or any other machine that may operate in a dirt and/or debris filled environment that is subject to having the air intake screen clogged with material needing periodic removal. Those skilled in the art will appreciate that in addition to having a fan reversing air flow purge cycle, the air circulation system would also inherently include a normal operation configuration in which air is circulated from the air intake screen through the housing of the machine and out of an outlet opening.

Figure 4:
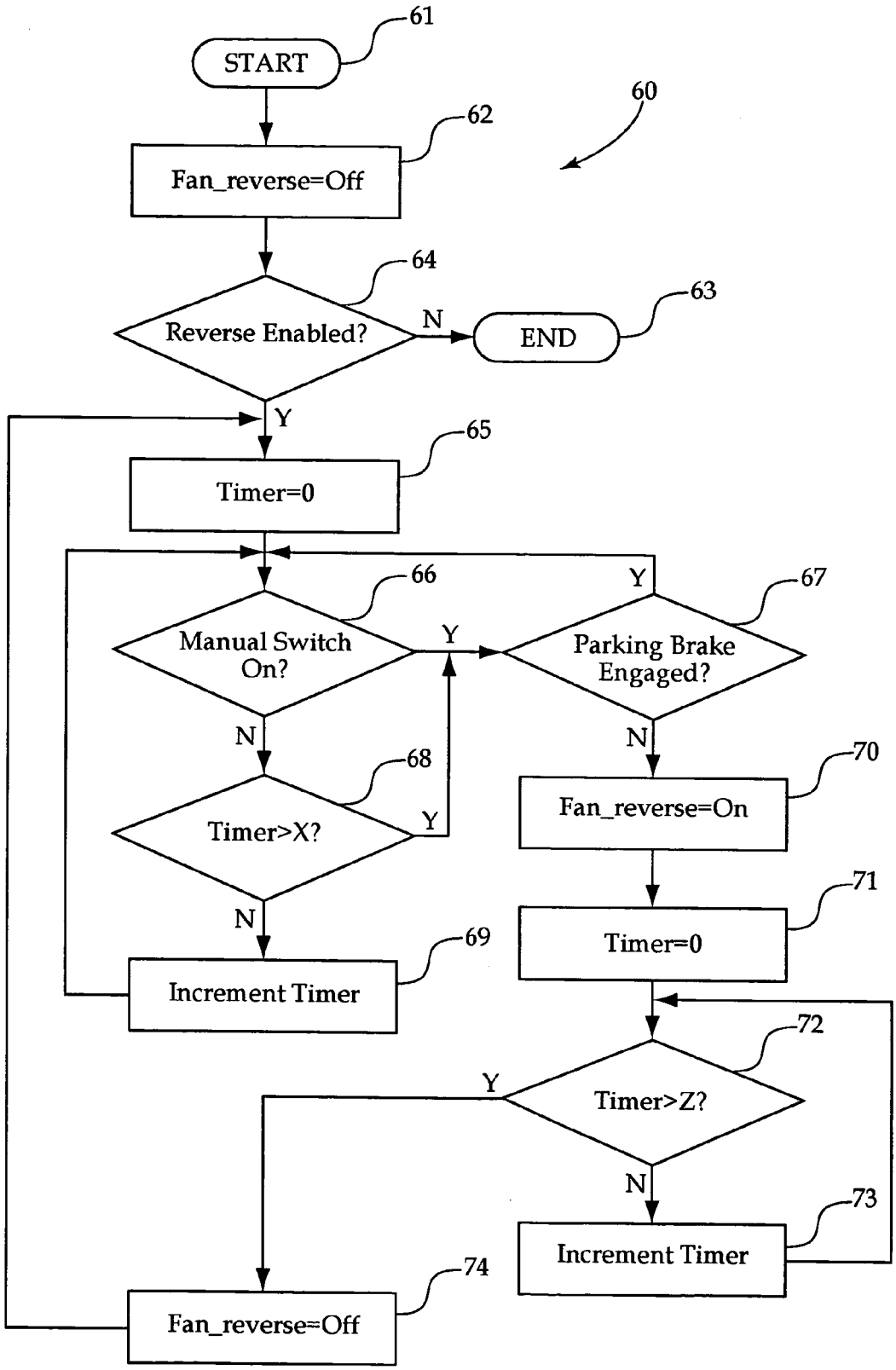
FIG. 4 is a software flow diagram for performing the methodology of the present disclosure.

Referring now to FIG. 4, a software flow diagram 60 shows an example logic sequence for implementing the fan control interlock feature of the present invention. At step 61 the software starts, and at box 62 the fan reverse cycle status is initialized to off. At step 64, the software queries whether the reverse feature is enabled. This aspect of the present disclosure may relate to the possibility of an operator having a possible override option to disable any fan reversing, or possibly relates to specific machine software where a fan reversing feature is not called for, and therefore the software relating to a potential fan reversing purge cycle is disabled. If the query response is answered by showing that the fan reversing is not enabled, the software ends at 63. Otherwise, the software proceeds to box 65 where a timer is initialized to zero. This timer initialization relates to a duration for operating the fan in a first operation configuration where a normal cooling cycle is being performed to pull air into the housing 21, 121 through the air intake screen 22, 122, and then out of the housing 21, 121 through an outlet opening 23, 123. For instance, this duration depending upon the operating environment of the machine, may be on the order of many minutes to an hour. At query 66, the software determines whether the manual fan configuration switch is on. If not, the software proceeds to query 68 where the controller determines whether the timer has incremented to a time period greater than the desired cycle duration X. If not, the timer is incremented, and the software loops back up to query the manual switch configuration.

If the manual switch configuration is on, the software proceeds to query 67 where it determines whether the machine is in a idle stationary condition. In the example software shown, this is accomplished by determining whether the parking brake is engaged. If the parking brake is engaged when the manual switch is activated, the software returns and cycles back to the manual switch query. Thus, an operator using the software flow diagram shown, can not put the machine in an idle stationary condition by engaging the parking brake, and then manually activate the reverse cycle fan switch. If the parking brake is not engaged, the fan reverse status is changed to on, and the controller communicates to the fan to initiate its reverse cycling. Depending upon the fan construction, this might be accomplished by first slowing the fan and then reversing its rotation direction, or may be accomplished by activating actuators to alter the pitch orientation of the fan blades to reverse the air flow direction.

At step 71, the timer is again initialized to zero for the purge cycle duration Z, which may be on the order of several seconds, such as thirty seconds. At query 72, the controller determines whether the timer has exceeded the purge cycle duration Z. If not, the timer is incremented and the fan reversing cycle continues, and the timer is re-queried until the duration has exceeded the purging cycle duration Z. When this is done, the fan reverse cycle is ended at step 74 and the software loops back to reinitialize timer at step 65 to return the fan to its normal air circulation cooling mode.

If the manual switch is off, but the normal cycle timer has exceeded the cooling cycle duration X at query 68, the software again loops toward query 67 where the controller determines whether the machine is in an idle stationary condition. If not, the fan reversing cycle proceeds as shown in steps 70-74 as previously discussed. If the machine is determined to be in an idle stationary condition, the software loops back to the manual switch query. It is expected that software having logic like that shown in Flow Diagram 60 will be continuously running when the fan is being operated to have a normal cooling cycle to circulate air across an engine and/or radiator. Those skilled in the art will appreciate that if the fan is not being used in a normal air circulation cycle, then there will likely be little or no debris accumulating on the air intake screen, and therefore, no purge cycling may be necessary.

Automatic fan air flow direction reversal reduces the need for an operator to stop the machine and manually clean the air intake screen. This allows the operator to stay more focused and productive in carrying out tasks, such as compacting or loading, with the machine. Although automatic air flow reversing to a large extent relieves the operator of this cleaning task, the present disclosure teaches a process by which the air flow reversing purge cycle can be avoided when a person is likely in the vicinity of the air intake screen. Those skilled in the art will appreciate that a wide variety of means can be utilized to determine whether a person is likely near the machine such that the purge cycle should be locked out. Experience has shown that these circumstances arise most often when the machine is idle stationary. Thus, the present disclosure relieves an operator of continuously monitoring and cleaning the air intake, and does so in a way that reduces the likelihood that debris dislodged from the air intake screen will be blown onto a person, such as the operator, who is servicing the machine or mounting or dismounting the same.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

We claim:

1. A machine comprising:

a chassis;

an air circulation system supported on the chassis and including a fan operably positioned between an air intake screen and an outlet opening of a housing;

the fan having a first operation configuration operable to move air from the air intake screen and then out of the housing through the outlet opening, and a second operation configuration operable to move air through the air intake screen in a direction opposite to the first operation configuration; and a controller in control communication with the fan and configured to operate the fan in one of the first operation configuration and second operation configuration, and being configured to lockout the second operation configuration when the machine is idle stationary.

2. The machine of claim 1 including a service point adjacent the air intake screen.

3. The machine of claim 1 including an operator station mounted on the chassis; and an access path to the operator station passing the air intake screen.

4. The machine of claim 3 wherein the chassis has a front separated from a back by first and second sides; and the air intake screen is located on the first side.

5. The machine of claim 4 including a parking brake; and the controller is configured to lockout the second operation configuration when the parking brake is engaged.

6. The machine of claim 5 wherein the controller is configured to maintain the lockout of the second operation configuration for a duration of time after the parking brake is turned disengaged.

7. The machine of claim 5 including a manual fan configuration switch positioned in the operator station and being operable to communicate an operator desired fan operation configuration to the controller.

8. The machine of claim 5 wherein the machine is a compactor.

9. The machine of claim 5 wherein the machine is a wheel loader.

10. The machine of claim 1 wherein the fan rotates in opposite directions when in the first and second operation configurations.

11. The machine of claim 1 wherein the fan rotates in a same direction in both the first and second operation configurations, but pitch angles of fan blades have different orientations in the first and second operation configurations.

12. A method of operating an air circulation system of a machine with a fan operably positioned between an air intake screen and an outlet opening of a housing, comprising:

operating the fan in a first operation configuration that moves air from the air intake screen and then out of the housing through the outlet opening;

removing debris from the air intake screen by operating the fan in a second operation configuration that moves air through the air intake screen in a direction opposite to the first operation configuration; and locking out the second operation configuration when the machine is idle stationary.

13. The method of claim 12 including determining whether the machine is idle stationary based upon at least one sensor.

14. The method of claim 13 wherein the sensor includes a parking brake status indicator; and the determining step includes determining whether the parking brake is engaged.

15. The method of claim 14 including maintaining a lock out of the second operation configuration for a duration after the parking brake is disengaged.

16. The method of claim 12 including a traversing an operator station access path that passes the air intake screen while the machine is idle stationary.

17. The method of claim 12 including accessing a service point of the machine that is adjacent the air intake screen when the machine is idle stationary.

18. The method of claim 12 including rotating the fan in a same direction, but changing orientations of fan blades, when in the first and second operation configurations, respectively.

19. The method of claim 12 including rotating the fan in opposite directions when the fan is in the first and second operation configurations.

20. The method of claim 12 including manually communicating an operator desired fan operation configuration from an operator station to a controller in control communication with the fan.

* * * * *